US006839068B2

(12) United States Patent
Yoshioka

(10) Patent No.: US 6,839,068 B2
(45) Date of Patent: Jan. 4, 2005

(54) PICTURE DISPLAYING METHOD AND INFORMATION DEVICE

(75) Inventor: Kenji Yoshioka, Tokyo (JP)

(73) Assignee: NEC Corporation, Tokyo (JP)

( * ) Notice: Subject to any disclaimer, the term of this patent is extended or adjusted under 35 U.S.C. 154(b) by 60 days.

(21) Appl. No.: 10/289,365

(22) Filed: Nov. 7, 2002

(65) Prior Publication Data

US 2003/0090497 A1 May 15, 2003

(30) Foreign Application Priority Data

Nov. 9, 2001 (JP) ..... 2001-344488

(51) Int. Cl.[7] ..... G09G 5/00
(52) U.S. Cl. ..... 345/670; 345/660; 345/667
(58) Field of Search ..... 345/838, 660, 345/670, 667

(56) References Cited

U.S. PATENT DOCUMENTS

| | | | | | |
|---|---|---|---|---|---|
| 5,548,692 | A | * | 8/1996 | Cok | 345/815 |
| 5,933,137 | A | * | 8/1999 | Anderson | 345/720 |
| 6,278,447 | B1 | * | 8/2001 | Anderson | 345/723 |
| 6,674,439 | B1 | * | 1/2004 | Shin et al. | 345/501 |
| 6,674,472 | B1 | * | 1/2004 | Tsutsui | 348/333.05 |
| 2003/0046167 | A1 | * | 3/2003 | Wada | 705/16 |

FOREIGN PATENT DOCUMENTS

| | | | | |
|---|---|---|---|---|
| EP | 0 895 187 A2 | | 7/1998 | |
| EP | 1 052 598 A2 | | 5/2000 | |
| JP | 11-250009 | | 9/1999 | |
| JP | 2000-310986 | | 11/2000 | |
| JP | 2001-28619 | | 1/2001 | |
| JP | 2001-34249 | | 2/2001 | |
| JP | 2001-228857 | * | 8/2001 | G09G/5/36 |
| JP | 2002-023914 | | 1/2002 | |
| JP | 2002-033953 | | 1/2002 | |

OTHER PUBLICATIONS

Jiebo Luo et al., "Displaying Images on Mobile Devices: Capabilities, Issues, and Solutions", pp. I–13–I–16, International Conference on Image Processing, 2002, vol. 1, published 2002, IEEE.

Japanese Office Action dated May 18, 2004, with partial English translation.

* cited by examiner

*Primary Examiner*—Kee M. Tung
*Assistant Examiner*—Alysa N. Brautigam
(74) *Attorney, Agent, or Firm*—McGinn & Gibb, PLLC

(57) ABSTRACT

If the main picture's size contained in a picture data file is equal to or smaller than the display's size of a displaying portion, a controlling portion displays the main picture in the display area. If the main picture's size is larger than the display's size and the picture data file does not contain a thumbnail, the controlling portion reduces the main picture's size and displays the reduced main picture. If the main picture's size is larger than the display's size and the thumbnail's size contained in the picture data file is equal to or smaller than the display's size, the controlling portion displays the thumbnail. If the main picture's size is larger than the display's size and the thumbnail's size contained in the picture data file is larger than the display's size, the controlling portion reduces the thumbnail's size and displays the reduced thumbnail.

24 Claims, 12 Drawing Sheets

PICTURE DISPLAYING METHOD AND INFORMATION DEVICE

BACKGROUND OF THE INVENTION

1. Field of the Invention

The present invention relates to an information device such as a cellular phone unit, a personal digital assistance and a personal computer, in particular, to an information device having a function for displaying a picture.

2. Description of the Related Art

Nowadays, mobile communication terminal units such as cellular phone units and simplified cellular phone units for use in mobile communication can transmit and receive picture data and display pictures. In the third generation mobile communication, the data communication rate is so high that picture data and so forth that have a large file size can be transmitted and received. Thus, third generation mobile communication terminal units can transmit and receive picture data having a much larger size in pixel than the current mobile communication terminal units can, although not reaching the ability of personal computers. Consequently, it can be expected that the third generation mobile communication terminal units will process picture data having large data sizes and display pictures having large size in pixel.

However, since cellular phone units and so forth are carried about by users, they should be small and light. Consequently, the sizes and resolutions of displays of the cellular phone units are restricted. Thus, it is difficult to display a picture having a large size in pixel at a time. To solve such a problem, normally, cellular phone units reduce the size of a picture of a large number of pixels or scroll a picture of a large number of pixels so as to display a part thereof at a time.

The reduced display is suitable for a user to grasp the whole picture. In contrast, the scroll display is suitable for a user to see the detail of a picture.

To reduce the size of a picture of a large number of pixels and display the reduced picture, a cellular phone unit or the like should perform a picture developing process, a picture reducing process corresponding to the number of dots and the resolution of the display, a picture drawing process, and so forth, and it takes a long time.

SUMMARY OF THE INVENTION

An object of the present invention is to provide a picture displaying method that allows a time period needed for an information device to display a picture having a large picture size to be decreased and an information device using the method.

According to a first aspect of the present invention, there is provided a picture displaying method for displaying a picture contained in a picture data file on a display area, the method comprising the steps of: displaying a main picture contained in the picture data file on the display area if the main picture's size in pixel is equal to or smaller than the display area's size in pixel; reducing the main picture's size in pixel and displaying the reduced main picture if the main picture's size in pixel is larger than the display area's size in pixel and a thumbnail is not contained in the picture data file; displaying the thumbnail on the display area if the main picture's size in pixel is larger than the display area's size in pixel, the thumbnail is contained in the picture data file, and the thumbnail's size in pixel is equal to or smaller than the display area's size in pixel; and reducing the thumbnail's size in pixel and displaying the reduced thumbnail if the main picture's size in pixel is larger than the display area's size in pixel, the thumbnail is contained in the picture data file, and the thumbnail's size in pixel is larger than the area's size in pixel.

According to a second aspect of the present invention, there is provided a picture displaying method for displaying a picture contained in a picture data file on a display area, the method comprising the steps of: displaying a main picture contained in the picture data file on the display area if the main picture's size in pixel is equal to or smaller than the display area's size in pixel; reducing the main picture's size in pixel and displaying the reduced main picture if the main picture's size in pixel is larger than the display area's size in pixel and a thumbnail is not contained in the picture data file; reducing the main picture's size in pixel and displaying the reduced main picture if the main picture's size in pixel is larger than the display area's size in pixel, the thumbnail is contained in the picture data file and a ratio of the thumbnail's size in pixel to the display area's size in pixel is equal to or less than a predetermined value; displaying the thumbnail on the display area if the main picture's size in pixel is larger than the display area's size in pixel, the thumbnail is contained in the picture data file, the thumbnail's size in pixel is equal to or smaller than the display area's size in pixel and the ratio of the thumbnail's size in pixel to the display area's size in pixel is greater than the predetermined value; and reducing the thumbnail's size in pixel and displaying the reduced thumbnail if the main picture's size in pixel is larger than the display area's size in pixel, the thumbnail is contained in the picture data file, and the thumbnail's size in pixel is larger than the area's size in pixel.

In the picture displaying method according to the first or second aspect of the present invention, the main picture's size in pixel may be determined to be larger than the display area's size in pixel at least if the main picture's height in pixel is greater than the display area's height in pixel, the main picture's size in pixel may be determined to be larger than the display area's size in pixel at least if the main picture's width in pixel is greater than the display area's width in pixel, the main picture's size in pixel may be determined to be smaller than the display area's size in pixel if the main picture's height in pixel is less than the display area's height in pixel and the main picture's width in pixel is less than the display area's width in pixel, the thumbnail's size in pixel may be determined to be larger than the display area's size in pixel at least if the thumbnail's height in pixel is greater than the display area's height in pixel, the thumbnail's size in pixel may be determined to be larger than the display area's size in pixel at least if the thumbnail's width in pixel is greater than the display area's width in pixel, and the thumbnail's size in pixel may be determined to be smaller than the display area's size in pixel if the thumbnail's height in pixel is less than the display area's height in pixel and the thumbnail's width in pixel is less than the display area's width in pixel.

These and other objects, features and advantages of the present invention will become more apparent in light of the following detailed description of a best mode embodiment thereof, as illustrated in the accompanying drawings.

DESCRIPTION OF PREFERRED EMBODIMENTS

Next, with reference to the accompanying drawings, embodiments of the present invention will be described.

(First Embodiment)

Figure 1:
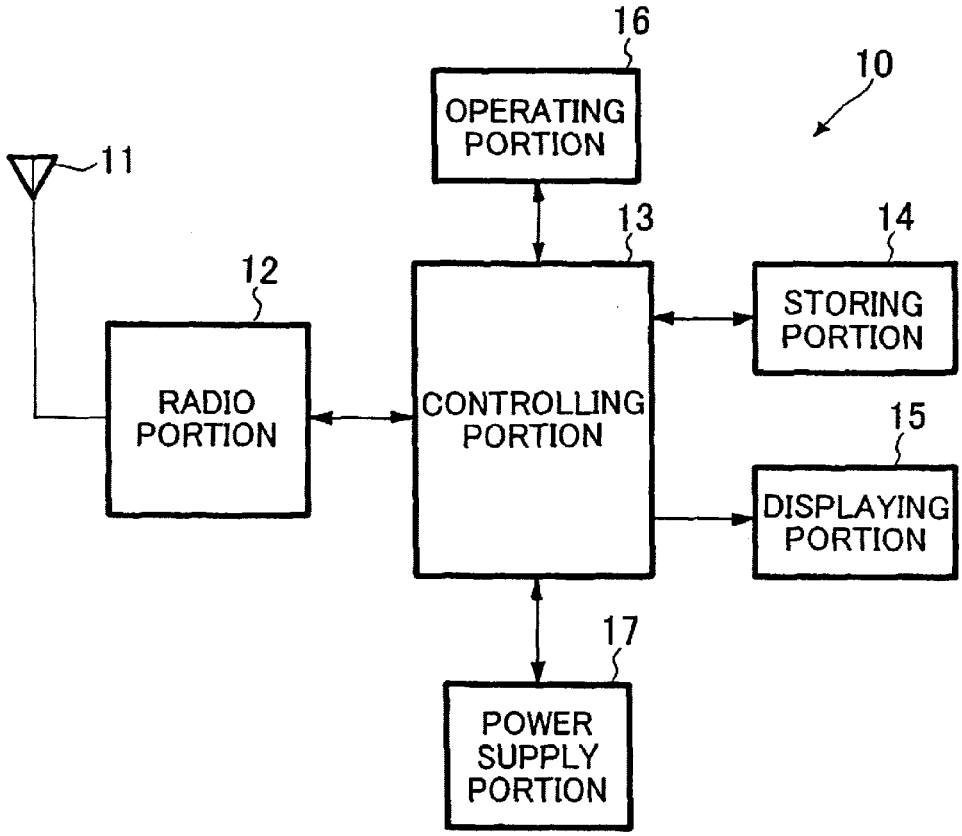
FIG. 1 is a block diagram showing the structure of a cellular phone unit according to a first embodiment of the present invention.

FIG. 1 is a block diagram showing the structure of a cellular phone unit according to an embodiment (hereinafter referred to as the first embodiment) of the present invention. With reference to FIG. 1, a cellular phone unit 10 has an antenna 11, a radio portion 12, a controlling portion 13, a storing portion 14, a displaying portion 15, an operating portion 16, and a power supply portion 17. The cellular phone unit 10 can be connected to a Web site (not shown) of the Internet by a user's operation. The cellular phone unit 10 downloads data from the Web site and displays a picture corresponding to the downloaded picture.

The antenna 11 transmits and receives a radio signal to and from a radio base station (not shown).

The radio portion 12 converts the frequency of a high frequency radio signal received by the antenna 11, removes noise from the radio signal, and demodulates the resultant signal to a digital signal.

The controlling portion 13 reads a program stored in the storing portion 14 and executes the program to operate. When picture data is downloaded from a Web site and displayed on the cellular telephone unit 10, the controlling portion 13 decodes the digital signal demodulated by the radio portion 12 and extracts picture data from the demodulated digital signal. The extracted picture data contains data of a main picture (hereinafter referred to as main picture data). In addition, the extracted picture data may contain picture data of a thumbnail (hereinafter referred to as thumbnail data). A thumbnail is a picture obtained by reducing the main picture's size in pixel to such an extent that a user can roughly grasp the main picture. Normally, the size in pixel is represented by the number of pixels along the height of a picture and the number of pixels along the width thereof.

If picture data does not contain thumbnail data, the controlling portion 13 causes main picture data to be displayed. In contrast, if picture data contains thumbnail data, the controlling portion 13 causes main picture data or thumbnail picture to be displayed corresponding to the resolution of the displaying portion 15.

The storing portion 14 stores programs for various processes and a variety of kinds of data necessary for the processes. In addition, the storing portion 14 contains an area for temporarily storing data used by the controlling portion 13 which executes various processes (hereinafter, the area is referred to as the work area).

Figure 11:
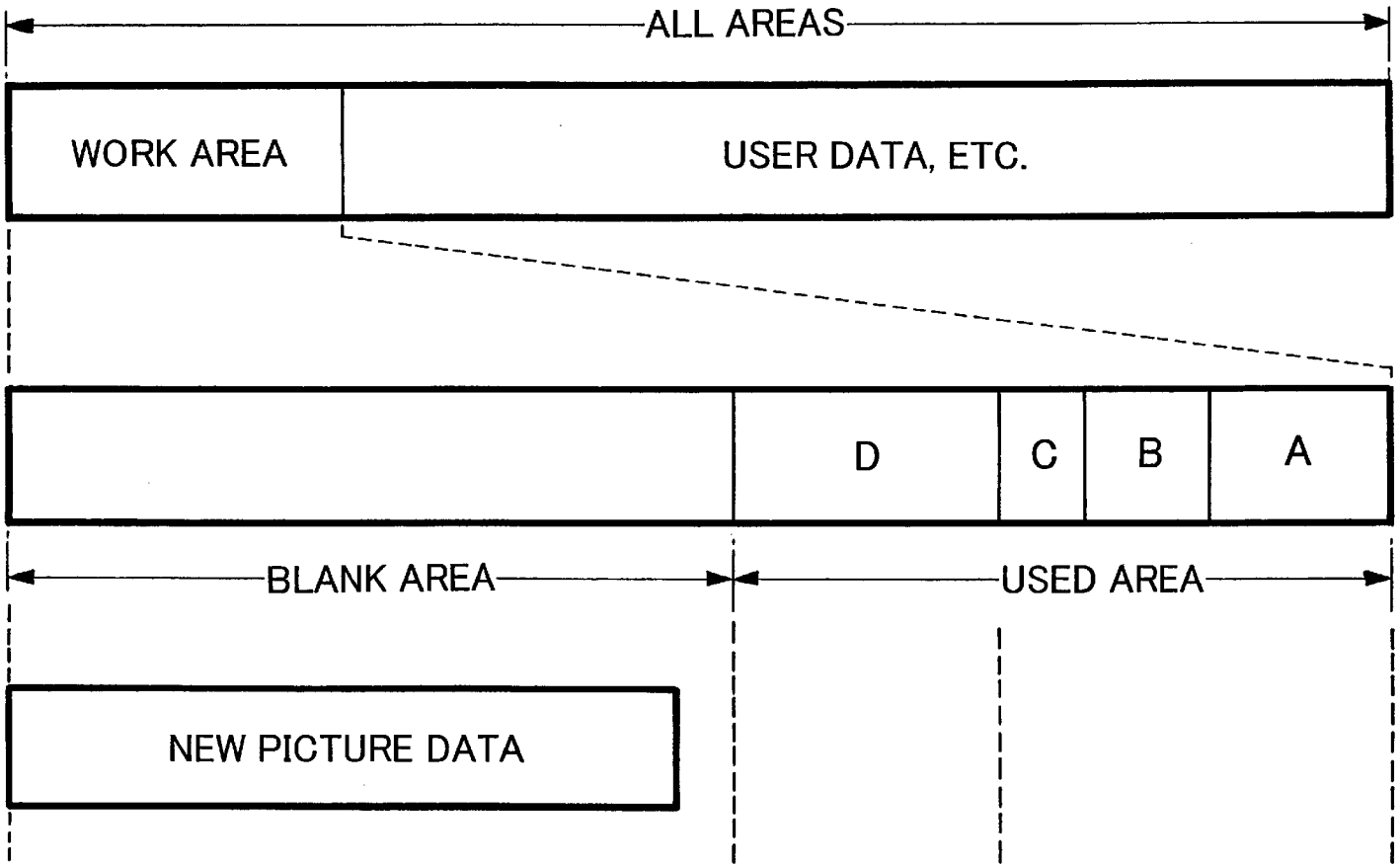
FIG. 11 is a schematic diagram showing each area of a memory of a storing portion.

FIG. 11 is a schematic diagram showing each area of a memory of the storing portion 14. Referring to FIG. 11, the storing portion 14 contains the work area. For example, when the controlling portion 13 executes a picture displaying process, the controlling portion 13 develops picture data to be displayed (new picture data in FIG. 11) into a blank area of the work area and executes the reducing process and so forth for the picture data.

The displaying portion 15 is a display that displays a picture corresponding to the picture data downloaded from the Web site.

The operating portion 16 is a user interface such as push buttons and so forth that are used to perform for example a call originating operation, a call receiving operation, and a Web page browsing operation.

The power supply portion 17 has a battery which supplies electric power to each portion of the cellular phone unit 10.

Figure 2:
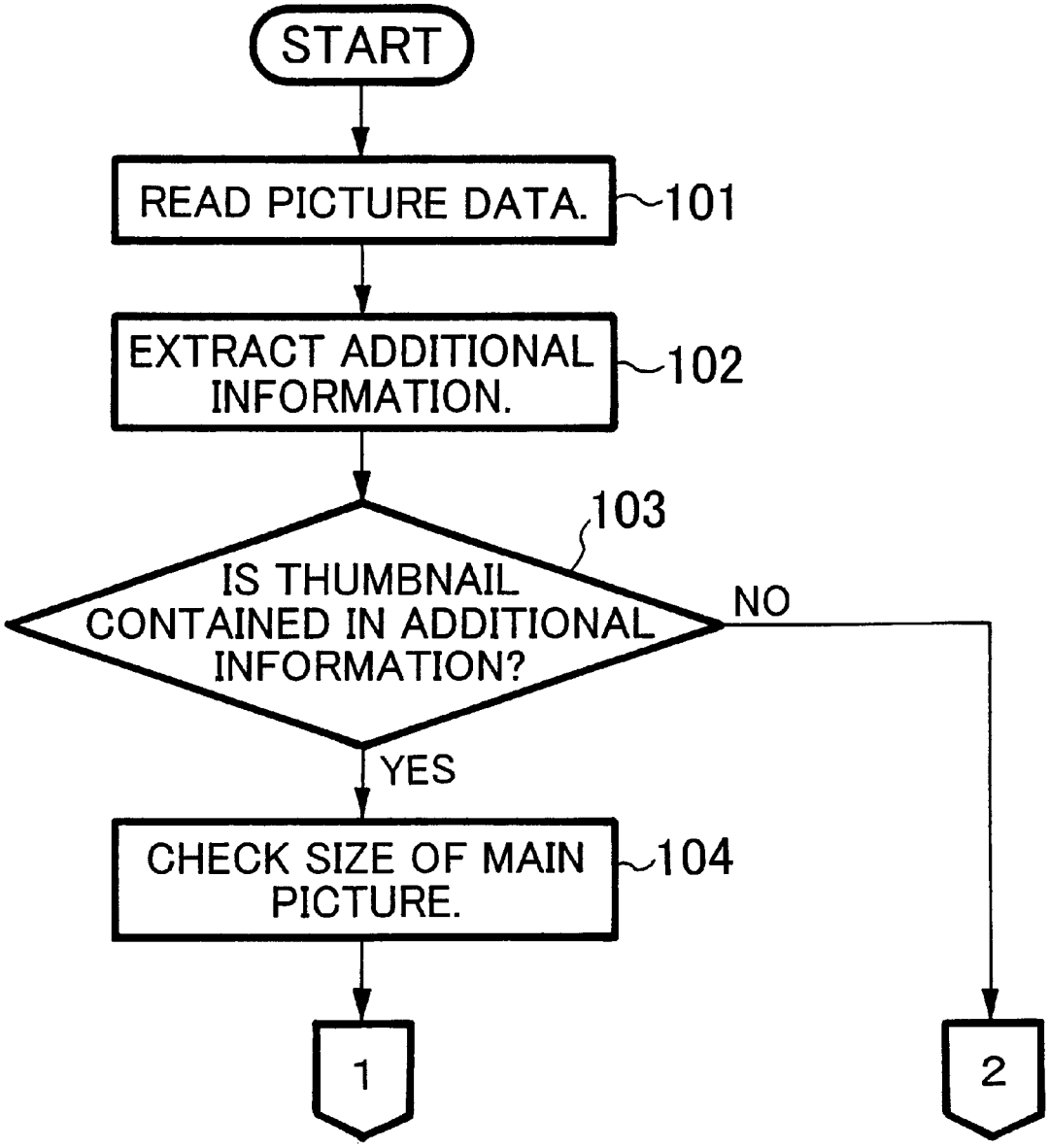
FIG. 2 is a flow chart showing an operation of the cellular phone unit according to the first embodiment of the present invention in the case that picture data is downloaded from a Web site and displayed.
Figure 3:
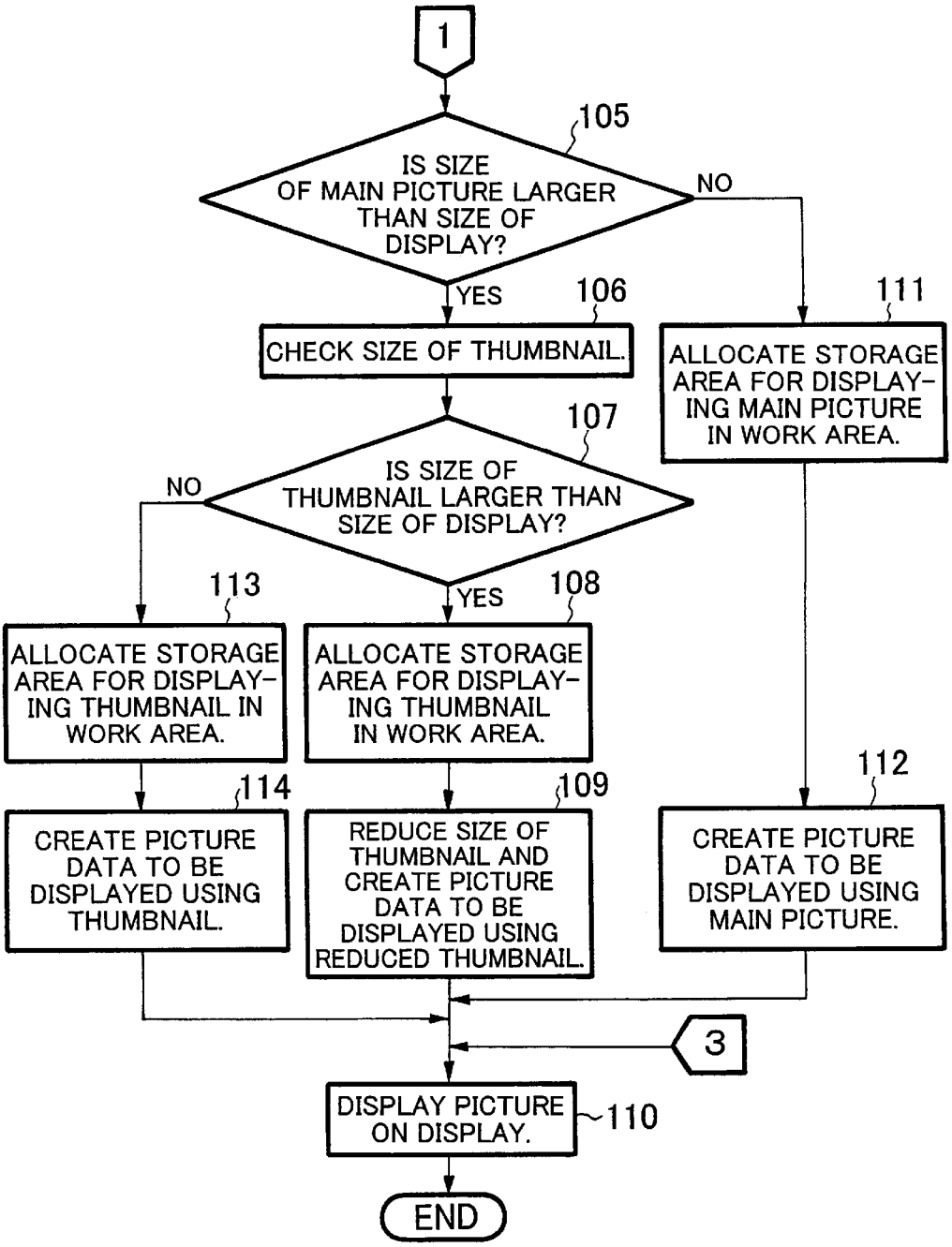
FIG. 3 is a flow chart showing the operation of the cellular phone unit according to the first embodiment of the present invention in the case that picture data is downloaded from the Web site and displayed.
Figure 4:
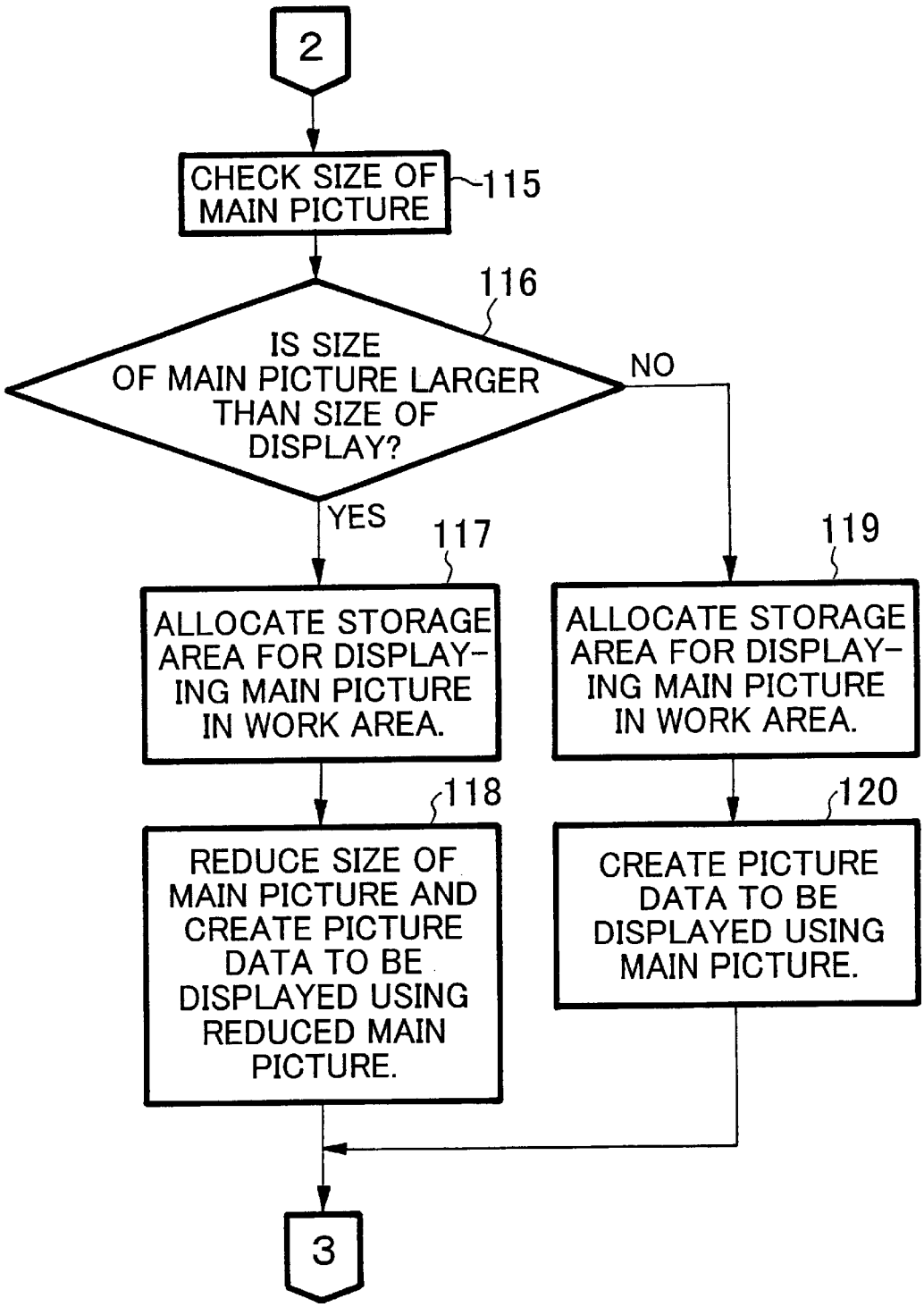
FIG. 4 is a flow chart showing the operation of the cellular phone unit according to the first embodiment of the present invention in the case that picture data is downloaded from the Web site and displayed.

FIGS. 2 to 4 are flow charts showing an operation of the cellular phone unit according to the first embodiment of the present invention in the case that picture data is downloaded from the Web site and displayed. When the controlling portion 13 executes a predetermined program recorded in the storing portion 14, the cellular phone unit 10 is operated.

With reference to FIGS. 2 to 4, the cellular phone unit 10 reads a file of the picture data downloaded from the Web site or the like to the storing portion 14 (at step 101).

Figure 12:
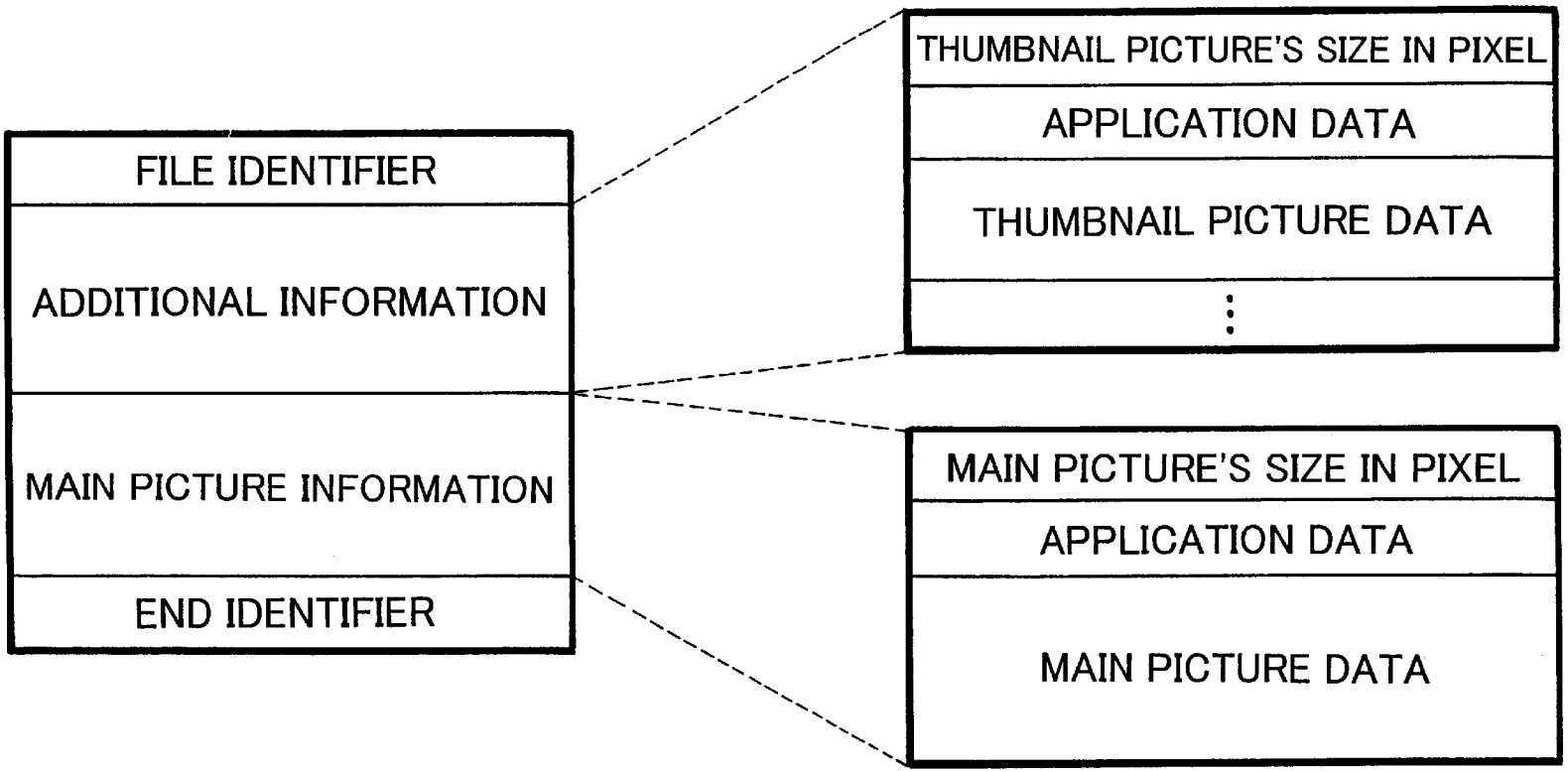
FIG. 12 is a schematic diagram showing an example of an outlined format of a picture data file.

FIG. 12 shows an example of an outlined format of a picture data file. Although there are a variety of formats of picture data files, in this example, a conventional data structure will be described. JPEG (Joint Photographic Experts Group), which is a representative standard for still pictures, has such a structure.

Referring to FIG. 12, a conventional picture data file contains a file identifier, additional information, main picture information, and an end identifier.

The file identifier represents the beginning of the picture data file. In addition, the file identifier represents the type of a file format. The end identifier represents the end of the picture data file.

The additional information contains information which can be designated for each application and information with respect to a picture such as size in pixel and resolution. The additional information may contain thumbnail information. The thumbnail information is composed of the thumbnail's size in pixel, application data, picture data, and so forth.

The main picture information contains the main picture's size in pixel recorded in the picture data file, application data, picture data, and so forth.

Next, the cellular phone unit 10 analyzes the picture data file and extracts the content of additional information from the picture data file (at step 102). Thereafter, the cellular phone unit 10 determines whether or not the additional information contains thumbnail information (at step 103).

If the additional information does not contain thumbnail information, the cellular phone unit 10 checks the main picture's size in pixel (at step 115). Thereafter, the cellular phone unit 10 determines whether or not the main picture's size in pixel is larger than the display's size in pixel (at step 116).

If the main picture's size in pixel is larger than the display's size in pixel, the cellular phone unit 10 allocates a storage area for the process for displaying the main picture in the work area of the storing portion 14 (at step 117). Thereafter, the cellular phone unit 10 develops the main picture data into the work area, reduces the main picture's size in pixel corresponding to the display's size in pixel of the displaying portion 15, and creates picture data which can be displayed on the displaying portion 15 using the reduced main picture data (at step 118).

Thereafter, the cellular phone unit 10 displays the picture corresponding to the picture data on the displaying portion 15 (at step 110). Now, the cellular telephone unit 10 completes the process.

If the determined result at step 116 represents that the main picture's size in pixel is equal to or smaller than the display's size in pixel of the displaying portion 15, the cellular phone unit 10 allocates a storage area for the process for displaying the main picture in the work area of the storing portion 14 (at step 119). Thereafter, the cellular phone unit 10 develops the main picture data into the work area and creates picture data to be displayed on the displaying portion 15 using the main picture data (at step 120). Thereafter, the flow advances to step 110. In this case, since the main picture's size in pixel is equal to or smaller than the display's size in pixel of the displaying portion 15, it is not necessary to reduce the main picture's size in pixel.

If the determined result at step 103 represents the additional information contains thumbnail information, the cellular phone unit 10 checks the main picture's size in pixel (at step 104). Thereafter, the cellular phone unit 10 determines whether or not the main picture's size in pixel is larger than the display's size in pixel of the displaying portion 15 (at step 105).

If the main picture's size in pixel is equal to or smaller than the display's size in pixel of the displaying portion 15, the cellular phone unit 10 allocates a storage area for the process for displaying the main picture in the work area (at step 111). Thereafter, the cellular phone unit 10 develops the main picture data into the work area and creates picture data to be displayed on the displaying portion 15 using the main picture data (at step 112). Thereafter, the flow advances to step 110. In this case, since the main picture's size in pixel is equal to or smaller than the display's size in pixel of the displaying portion 15, it is not necessary to reduce the main picture's size in pixel.

If the determined result at step 105 represents that the main picture's size in pixel is larger than the display's size in pixel of the displaying portion 15, the cellular phone unit 10 checks the thumbnail's size in pixel (at step 106).

Thereafter, the cellular phone unit 10 determines whether or not the thumbnail's size in pixel is larger than the display's size in pixel of the displaying portion 15 (at step 107).

If the thumbnail's size in pixel is equal to or smaller than the display's size in pixel of the displaying portion 15, the cellular phone unit 10 allocates a storage area for a process for displaying the thumbnail picture in the work area (at step 113). Thereafter, the cellular phone unit 10 develops thumbnail data into the work area and creates picture data to be displayed on the displaying portion 15 using the thumbnail data (at step 114). Thereafter, the flow advances to step 110. In this case, since the thumbnail's size in pixel is equal to or smaller than the display's size in pixel of the displaying portion 15, it is not necessary to reduce thumbnail's size in pixel.

If the determined result at step 107 represents that the thumbnail's size in pixel is larger than the display's size in pixel of the displaying portion 15, the cellular phone unit 10 allocates a storage area for the process for displaying the thumbnail picture in the work area (at step 108). Thereafter, the cellular phone unit 10 develops the thumbnail data into the work area, reduces the thumbnail's size in pixel corresponding to the display's size in pixel of the displaying portion 15, and creates picture data which can be displayed on the displaying portion 15 using the reduced thumbnail data (at step 109). Thereafter, the flow advances to step 110. Since the thumbnail's size in pixel is smaller than the main picture's size in pixel, the load for the reducing process for the thumbnail is lighter than the load for the reducing process for the main picture.

If the main picture's size in pixel is equal to or smaller than the display's size in pixel, the cellular phone unit 10 according to the first embodiment displays the main picture as it is. If the main picture's size in pixel is larger than the display's size in pixel and the picture data file does not contain a thumbnail, the cellular phone unit 10 reduces the main picture's size in pixel and displays the reduced picture. If the main picture's size in pixel is larger than the display's size in pixel, the picture data file contains a thumbnail, and the thumbnail's size in pixel is equal to or smaller than the display's size in pixel, then the cellular phone unit 10 displays the thumbnail as it is. If the main picture's size in pixel is larger than the display's size in pixel, the picture data file contains a thumbnail, and the thumbnail's size in pixel is larger than the display's size in pixel, then the cellular phone unit 10 reduces the thumbnail's size in pixel and displays the reduced thumbnail. Thus, the number of times of the picture reducing process is decreased. In addition, the load of one reducing process is light.

Normally, the picture's size in pixel is represented by the number of pixels along the height of the picture and the number of pixels along the width thereof. The display's size in pixel is represented by the number of pixels along the height of the display and the number of pixels along the width thereof When it is determined whether or not the picture's size in pixel is larger than the display's size in pixel, for example, the height of the picture is compared with the height of the display and then the width of the picture is compared with the width of the display. If at least one of the height and width of the picture is larger than one of the height and width of the display, it is determined that the picture's size in pixel is larger than the display's size in pixel. This is because if one of the height and width of a picture is larger than the height and width of the display, the reducing process for the picture is required. In addition, if either the height or width of a picture is larger than the height or width of the display, respectively, it is preferred to reduce the picture's size in pixel in both the directions to maintain aspect ratio.

(Second Embodiment)

Figure 5:
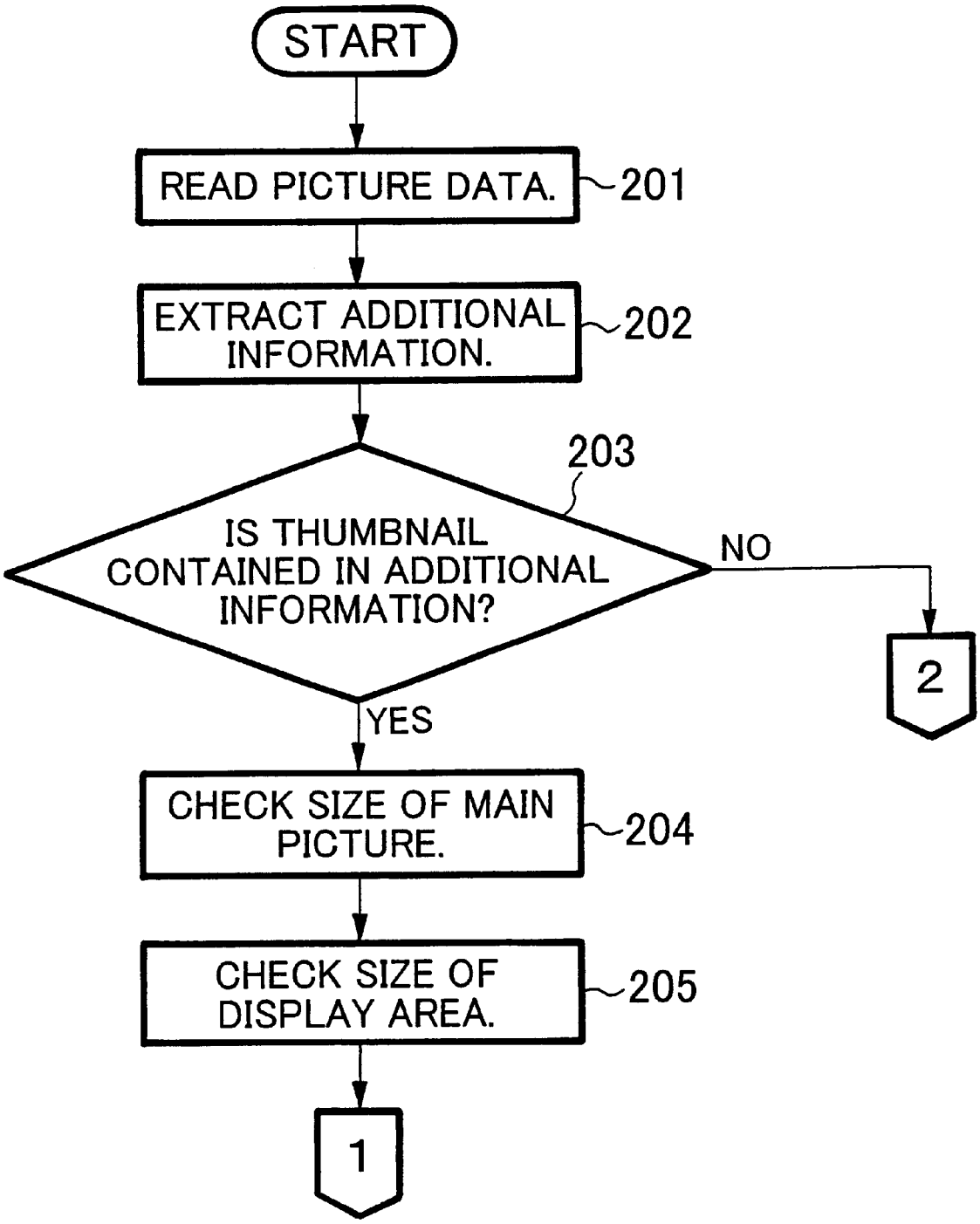
FIG. 5 is a flow chart showing an operation of a cellular phone unit according to a second embodiment of the present invention in the case that picture data is downloaded from a Web site and displayed.
Figure 6:
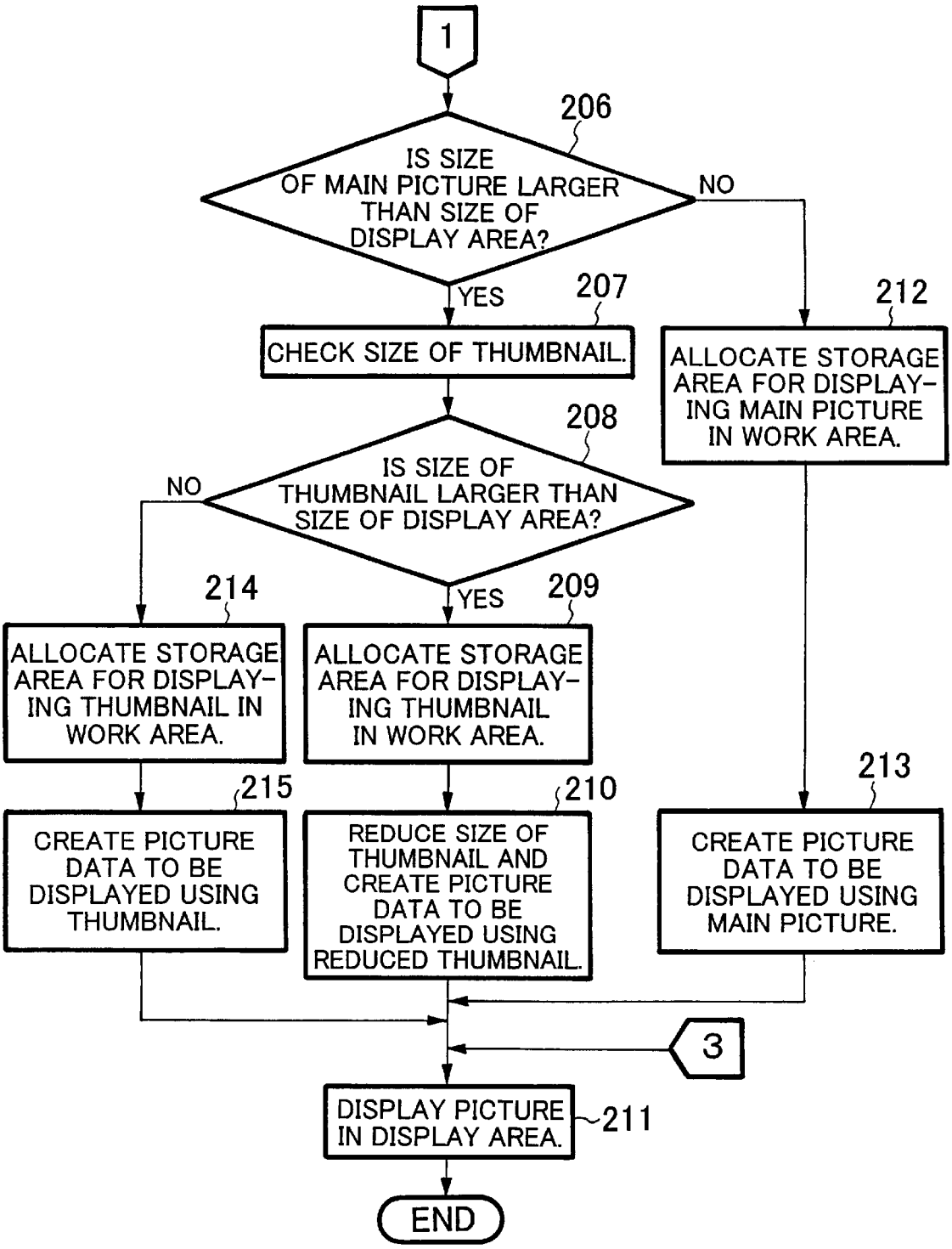
FIG. 6 is a flow chart showing the operation of the cellular phone unit according to the second embodiment of the present invention in the case that picture data is downloaded from the Web site and displayed.
Figure 7:
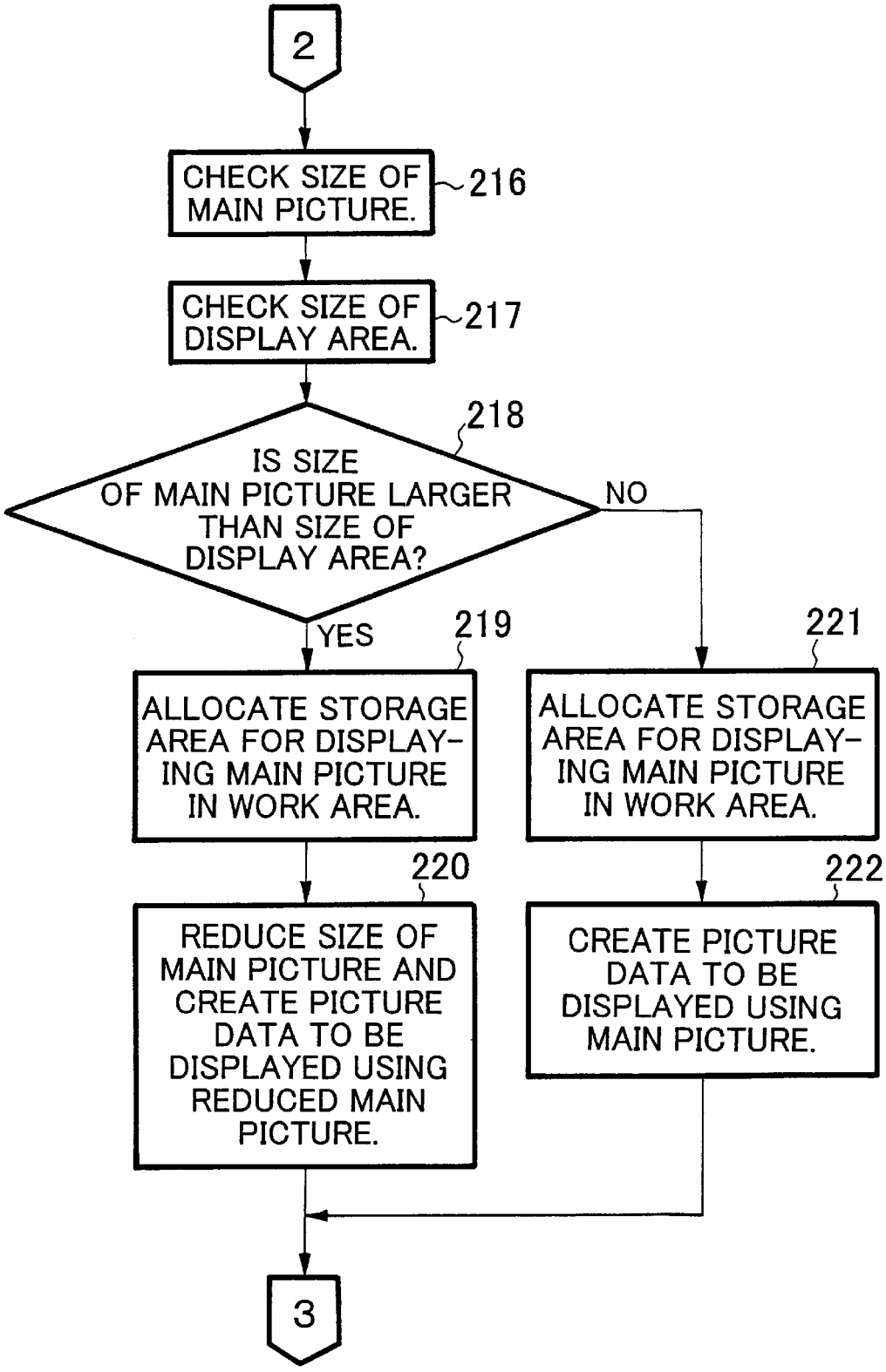
FIG. 7 is a flow chart showing the operation of the cellular phone unit according to the second embodiment of the present invention in the case that picture data is downloaded from the Web site and displayed.

FIGS. 5 to 7 are flow charts showing an operation of a cellular phone unit according to another embodiment (hereinafter referred to as the second embodiment) of the present invention in the case that picture data is downloaded from a Web site and displayed. Although the structure of the cellular phone unit according to the second embodiment is the same as the structure as shown in FIG. 1, process of application programs are different therebetween. According to the second embodiment, when the cellular phone unit displays a picture, the picture is not always displayed on all the display, but a predetermined area in the display (hereinafter this area is referred to as the display area).

With reference to FIGS. 5 to 7, first of all, the cellular phone unit 10 reads a file of picture data downloaded from a Web site or the like to the storing portion 14 (at step 201). Thereafter, the cellular phone unit 10 analyzes the picture data file and extracts the content of additional information from the picture data file (at step 202). Thereafter, the cellular phone unit 10 determines whether or not the additional information contains thumbnail information (at step 203).

If the additional information does not contain thumbnail information, the cellular phone unit 10 checks the main picture's size in pixel (at step 216). Thereafter, the cellular phone unit 10 checks the display area's size in pixel (at step 217). Thereafter, the cellular phone unit 10 determines whether or not the main picture's size in pixel is larger than the display area's size in pixel (at step 218).

If the main picture's size in pixel is larger than the display area's size in pixel, the cellular phone unit 10 allocates a storage area for a process for displaying the main picture in the work area of the storing portion 14 (at step 219). Thereafter, the cellular phone unit 10 develops main picture into the work area as shown in FIG. 12, reduces the main picture's size in pixel corresponding to the display area's size in pixel area, and creates picture data which can be displayed in the display area using the reduced main picture data (at step 220).

Thereafter, the cellular phone unit 10 displays a picture corresponding to the created picture data on the displaying portion 15 (at step 211). Now, the cellular phone unit 10 completes the process.

If the determined result at step 218 represents that the main picture's size in pixel is equal to or smaller than the display area's size in pixel, the cellular phone unit 10 allocates a storage area for the process for displaying the main picture in the work area of the storing portion 14 (at step 221). Thereafter, the cellular phone unit 10 develops main picture data into the work area and creates picture data to be displayed using the main picture data (at step 222). Thereafter, the flow advance to step 210. In this case, since the main picture's size in pixel is equal to or smaller than the display area's size in pixel, it is not necessary to reduce the main picture's size in pixel.

If the determined result at step 203 represents that the additional information contains thumbnail information, the cellular phone unit 10 checks the main picture's size in pixel (at step 204). Thereafter, the cellular phone unit 10 checks the display area's size in pixel (at step 205). Thereafter, the cellular phone unit 10 determines whether or not the main picture's size in pixel is larger than the display area's size in pixel (at step 206).

If the main picture's size in pixel is equal to or smaller than the display area's size in pixel, the cellular phone unit 10 allocates a storage area for the process for displaying the main picture in the work area (at step 212). Thereafter, the cellular phone unit 10 develops main picture data into the work area and creates picture data to be displayed using the main picture data (at step 213). Thereafter, the flow advances to step 211. In this case, since the main picture's size in pixel is smaller than the display area's size in pixel, it is not necessary to reduce the main picture's size in pixel.

If the determined result at step 206 represents that the main picture's size in pixel is larger than the display area's size in pixel, the cellular phone unit 10 checks the thumbnail's size in pixel (at step 207).

Thereafter, the cellular phone unit 10 determines whether or not the thumbnail's size in pixel is larger than the display area's size in pixel (at step 208).

If the thumbnail's size in pixel is equal to or smaller than the display area's size in pixel, the cellular phone unit 10 allocates a storage area for a process for displaying the thumbnail picture in the work area (at step 214). Thereafter, the cellular phone unit 10 develops thumbnail data into the work area and creates picture data to be displayed using the thumbnail data (at step 215). Thereafter, the flow advances to step 211. In this case, since the thumbnail's size in pixel is equal to or smaller than the display area's size in pixel, it is not necessary to reduce the thumbnail's size in pixel.

If the determined result at step 208 represents that the thumbnail's size in pixel is larger than the display area's size in pixel, the cellular phone unit 10 allocates a storage area for the process for displaying the thumbnail picture in the work area (at step 209). Thereafter, the cellular phone unit 10 develops thumbnail data into the work area, reduces the thumbnail's size in pixel corresponding to the display area's size in pixel, and creates picture data to be displayed using the reduced thumbnail data (at step 210). Thereafter, the flow advances to step 211. Since the thumbnail's size in pixel is smaller than the main picture's size in pixel, the load for the reducing process for the thumbnail is lighter than the load for the reducing process for the main picture.

In the cellular phone unit 10 which is operated as shown in FIGS. 5 to 7, the number of times of the picture reducing process is decreased depending on the display area's size in pixel which varies corresponding to an application program, the presence/absence of a thumbnail, the main picture's size in pixel and the thumbnail's size in pixel. In addition, the cellular phone unit 10 selects picture data and displays the selected picture data so that the load of one reducing process becomes light. Thus, even if the display area's size in pixel varies, the cellular phone unit 10 can optimally reduce the load for the process.

In addition, if either the height or width of a picture is larger than the height or width of the display, respectively, it is preferred to reduce the picture's size in pixel in both the directions to maintain aspect ratio.

(Third Embodiment)

Figure 8:
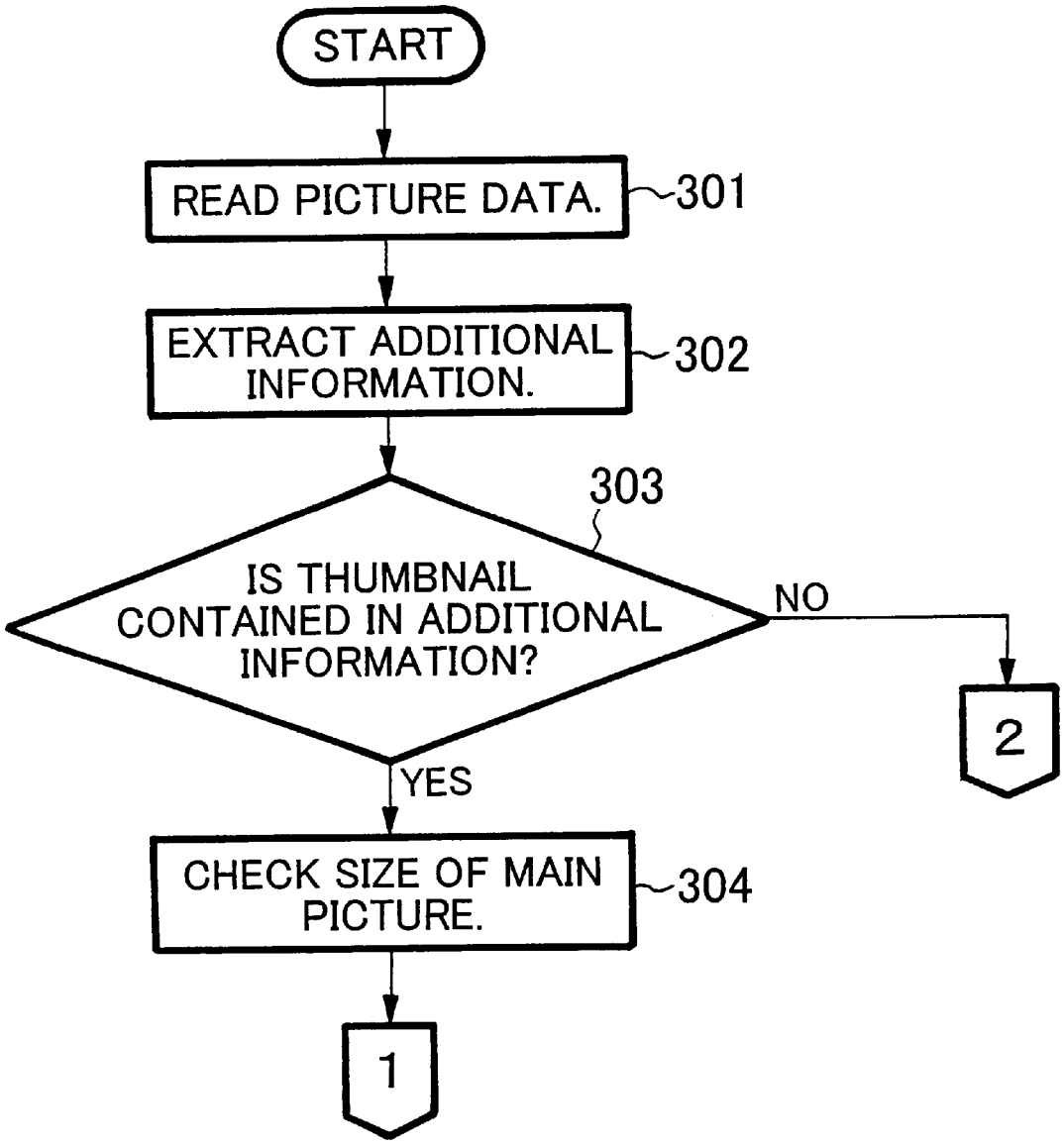
FIG. 8 is a flow chart showing an operation of a cellular phone unit according to a third embodiment of the present invention in the case that picture data is downloaded from a Web site and displayed.
Figure 9:
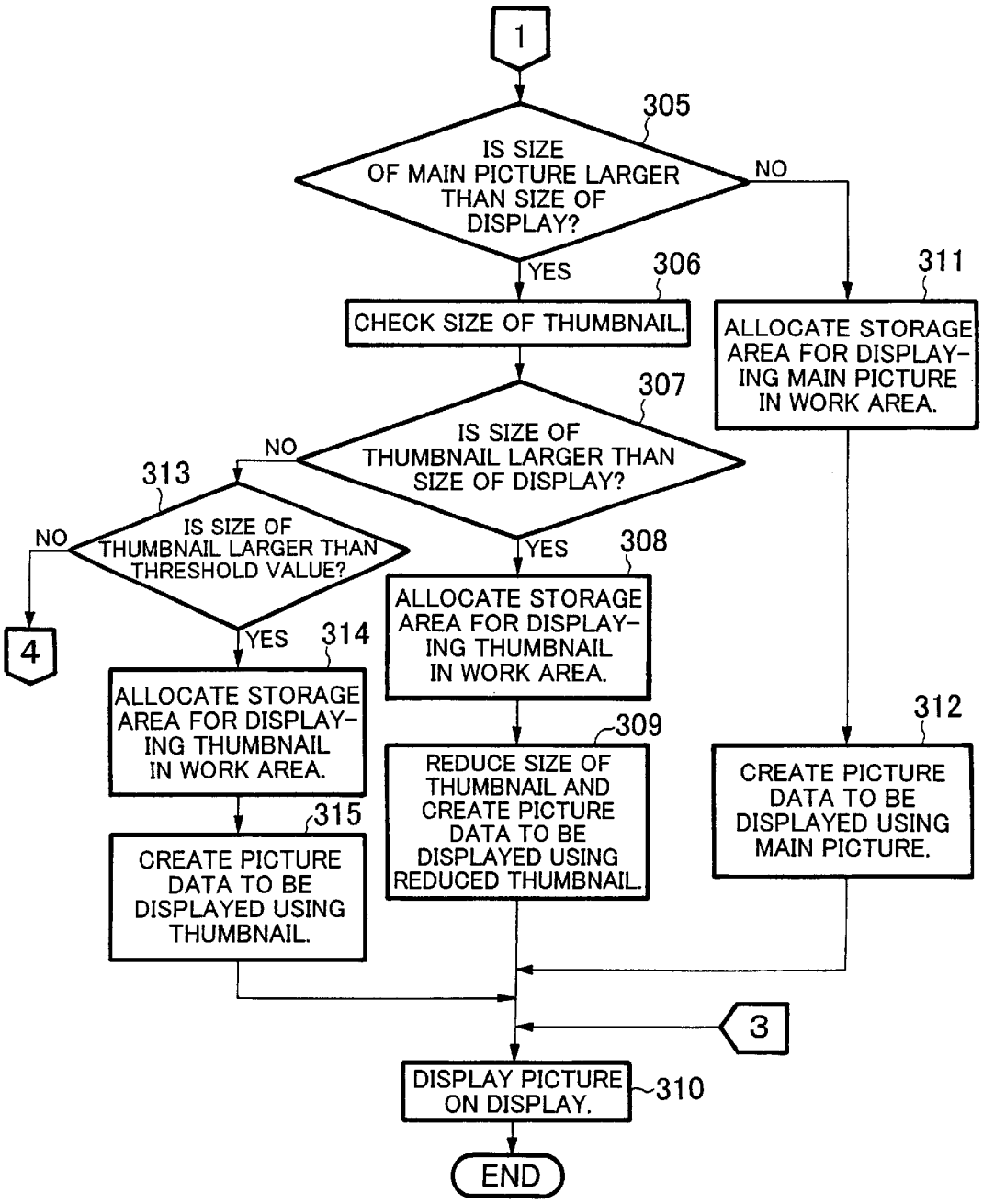
FIG. 9 is a flow chart showing the operation of the cellular phone unit according to the third embodiment of the present invention in the case that picture data is downloaded from the Web site and displayed.
Figure 10:
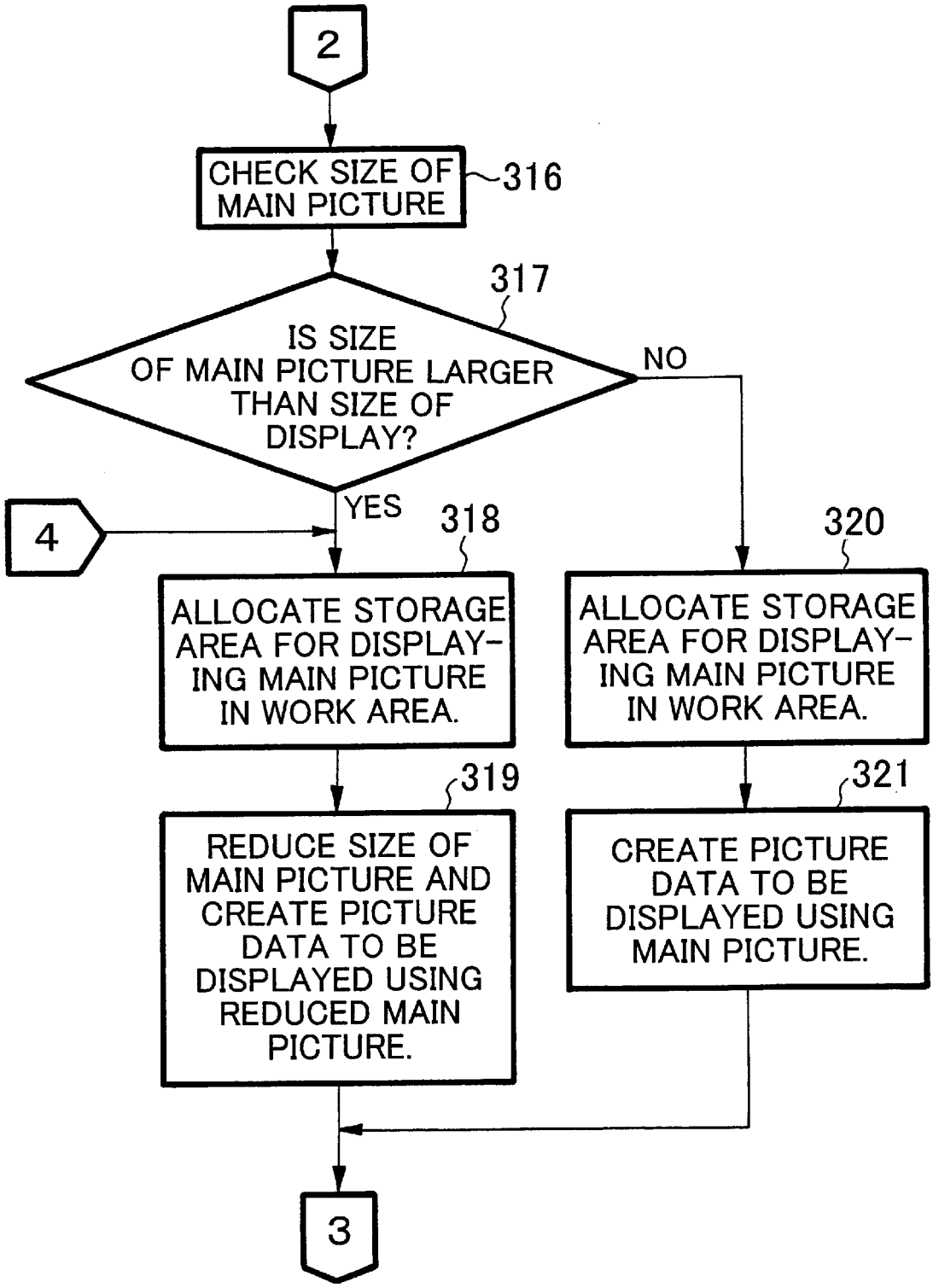
FIG. 10 is a flow chart showing the operation of the cellular phone unit according to the third embodiment of the present invention in the case that picture data is downloaded from the Web site and displayed.

FIGS. 8 to 10 are flow charts showing an operation of a cellular phone unit according to a further embodiment (hereinafter referred to as the third embodiment) of the present invention in the case that picture data is downloaded from a Web site and displayed. Although the structure of the cellular phone unit according to the third embodiment is the same as the structure of the cellular phone unit shown in FIG. 1, process of application programs are different therebetween.

If the thumbnail's size in pixel is much smaller than the display's size in pixel and the thumbnail is displayed instead of a main picture, the display cannot be effectively used. Thus, the user may not grasp the whole picture. In this case, the cellular phone unit 10 according to the third embodiment reduces the main picture's size in pixel and displays the reduced main picture.

With reference to FIGS. 8 to 10, the cellular phone unit 10 reads a file of picture data downloaded from a Web site or the like to the storing portion 14 (at step 301).

Thereafter, the cellular phone unit 10 analyzes the picture data file and extracts the content of additional information from the picture data file (at step 302). Thereafter, the cellular phone unit 10 determines whether or not the additional information contains thumbnail information (at step 303).

If the additional information does not contain thumbnail information, the cellular phone unit 10 checks the main picture's size in pixel (at step 316). Thereafter, the cellular phone unit 10 determines whether or not the main picture's size in pixel is larger than the display's size in pixel of the displaying portion 15 (at step 317).

If the main picture's size in pixel is larger than the display's size in pixel of the displaying portion 15, the cellular phone unit 10 allocates a storage area for a process for displaying the main picture in the work area of the storing portion 14 (at step 318). Thereafter, the cellular phone unit 10 develops main picture data into the work area as shown in FIG. 12, reduces the main picture's size in pixel corresponding to the display's size in pixel of the displaying portion 15, and creates picture data which can be displayed using the reduced main picture data (at step 319).

Thereafter, the cellular phone unit 10 displays a picture corresponding to the picture data to be displayed on the displaying portion 15 (at step 310). Now, the cellular phone unit 10 completes the process.

If the determined result at step 317 represents that the main picture's size in pixel is equal to or smaller than the display's size in pixel of the displaying portion 15, the cellular phone unit 10 allocates a storage area for the process for displaying the main picture in the work area of the storing portion 14 (at step 320). Thereafter, the cellular phone unit 10 develops main picture data into the work area and creates picture data to be displayed on the displaying portion 15 using the main picture data (at step 321). Thereafter, the flow advances to step 310. In this case, since the main picture's size in pixel is equal to or smaller than the display's size in pixel of the displaying portion 15, it is not necessary to reduce the main picture's size in pixel.

If the determined result at step 303 represents that the additional information contains thumbnail information, the cellular phone unit 10 checks the main picture's size in pixel (at step 304). Thereafter, the cellular phone unit 10 determines whether or not the main picture's size in pixel is larger than the display's size in pixel of the displaying portion 15 (at step 305).

If the main picture's size in pixel is equal to or smaller than the display's size in pixel of the displaying portion 15, the cellular phone unit 10 allocates a storage area for the process for displaying the main picture in the work area (at step 311). Thereafter, the cellular phone unit 10 develops main picture data into the work area and creates picture data to be displayed using the main picture data (at step 312). Thereafter, the flow advances to step 310. In this case, since the main picture's size in pixel is equal to or smaller than the display's size in pixel of the displaying portion 15, it is not necessary to reduce the main picture's size in pixel.

If the determined result at step 305 represents that the main picture's size in pixel is larger than the display's size in pixel of the displaying portion 15, the cellular phone unit 10 checks the thumbnail's size in pixel (at step 306).

Thereafter, the cellular phone unit 10 determines whether or not the thumbnail's size in pixel is larger than the display's size in pixel of the displaying portion 15 (at step 307).

If the thumbnail's size in pixel is equal to or smaller than the display's size in pixel of the displaying portion 15, the cellular phone unit 10 determines whether or not the ratio of the thumbnail's size in pixel to the display's size in pixel is larger than a predetermined threshold value (at step 313).

If the ratio of the thumbnail's size in pixel to the display's size in pixel is equal to or smaller than the predetermined threshold value, the flow advances to step 318. If the ratio of the thumbnail's size in pixel to the display's size in pixel is larger than the predetermined threshold value, the cellular phone unit 10 allocates a storage area for the process for displaying the thumbnail picture in the work area (at step 314). Thereafter, the cellular phone unit 10 develops thumbnail data into the work area and creates picture data to be displayed on the displaying portion 15 using the thumbnail data (at step 315). Thereafter, the flow advances to step 310. In this case, since the thumbnail's size in pixel is equal to or smaller than the display's size in pixel of the displaying portion 15, it is not necessary to reduce the thumbnail's size in pixel.

If the determined result at step 307 represents that the thumbnail's size in pixel is larger than the display's size in pixel of the displaying portion 15, the cellular phone unit 10 allocates a storage area for the process for displaying the thumbnail picture in the work area (at step 308). Thereafter, the cellular phone unit 10 develops thumbnail data into the work area, reduces the thumbnail's size in pixel corresponding to the display's size in pixel of the displaying portion 15, and creates picture data which can be displayed on the displaying portion 15 using the reduced thumbnail data (at step 309). Thereafter, the flow advances to step 310. Since the thumbnail's size in pixel is smaller than the main picture's size in pixel, the load for the reducing process for the thumbnail is lighter than the load for the reducing process for the main picture.

The cellular phone unit 10 which is operated as shown in FIGS. 8 to 10 selects a main picture or a thumbnail so that the load for the reducing process becomes light. If the ratio of the thumbnail's size in pixel to the display's size in pixel is smaller than the predetermined threshold value, then the cellular phone unit 10 selects the main picture and displays it, though the load for the reducing process for the thumbnail is lighter than the load for the reducing process for the main picture. Thus, while the picture quality with which the user can grasp the whole picture is assured, the load for the process can be decreased.

If either the height or width of a picture is larger than the height or width of the display, respectively, it is preferred to reduce the picture's size in pixel in both the directions to maintain aspect ratio.

According to the present invention, the number of times of the picture reducing process is decreased depending on the display area's size in pixel, the presence/absence of a thumbnail, the main picture's size in pixel and the thumbnail's size in pixel. In addition, the load of one reducing process becomes light. Thus, a time period necessary for displaying a picture can be decreased.

In addition, in the range that a picture quality is assured, the load for the process is effectively decreased. As a result, while the picture quality is assured, a time period necessary for displaying a picture can be decreased.

Although the above embodiments assume a cellular phone unit as an information device. However, the information device may be a personal digital assistance, a personal computer and so forth.

Although the present invention has been shown and described with respect to the best mode embodiment thereof, it should be understood by those skilled in the art that the foregoing and various other changes, omissions, and additions in the form and detail thereof may be made therein without departing from the spirit and scope of the present invention.

What is claimed is:

1. A picture displaying method for displaying, on a display area, a picture contained in a picture data file, said method comprising:

determining whether the size in pixels of a main picture contained in the picture data file is equal to or smaller than the display area's size in pixels;

determining whether a thumbnail is contained in the picture data file;

if a thumbnail is contained in the picture file, determining whether the thumbnail's size in pixels is equal to or smaller than the display area's size in pixels;

displaying the main picture on the display area if the main picture's size in pixels is equal to or smaller than the display area's size in pixels;

reducing the main picture's size in pixels and displaying the reduced main picture on the display area if the main picture's size in pixels is not equal to or smaller than the display area's size in pixels and a thumbnail is not contained in the picture data file;

displaying the thumbnail on the display area if the main picture's size in pixels is not equal to or smaller than the display area's size in pixels, the thumbnail is contained in the picture data file, and the thumbnail's size in pixels is equal to or smaller than the display area's size in pixels; and reducing the thumbnail's size in pixels and displaying the reduced thumbnail on the display area if the main picture's size in pixels is not equal to or smaller than the display area's size in pixels, the thumbnail is contained in the picture data file, and the thumbnail's size in pixels is not equal to or smaller than the display area's size in pixels.

2. The picture displaying method as set forth in claim 1, wherein:

the main picture's size in pixels is determined to be not equal to or smaller than the display area's size in pixels if the main picture's height in pixels is greater than the display area's height in pixels or the main picture's width in pixels is greater than the display area's width in pixels, the main picture's size in pixels is determined to be smaller than the display area's size in pixels if the main picture's height in pixels is less than the display area's height in pixels and the main picture's width in pixels is less than the display area's width in pixels, the thumbnail's size in pixels is determined to be not equal to or smaller than the display area's size in pixels if the thumbnail's height in pixels is greater than the display area's height in pixels or the thumbnail's width in pixels is greater than the display area's width in pixels, and the thumbnail's size in pixels is determined to be smaller than the display area's size in pixels if the thumbnail's height in pixels is less than the display area's height in pixels and the thumbnail's width in pixels is less than the display area's width in pixels.

3. A picture displaying method for displaying, on a display area, a picture contained in a picture data file, said method comprising:

determining whether the size in pixels of a main picture contained in the picture data file is equal to or smaller than the display area's size in pixels;

determining whether a thumbnail is contained in said picture data file;

if a thumbnail is contained in the picture data file, determining whether a ratio of the thumbnail's size in pixels to the display area's size in pixels is equal to or less than a predetermined value;

if a thumbnail is contained in the picture data file, determining whether the thumbnail's size in pixels is equal to or smaller than the display area's size in pixels;

displaying the main picture on the display area if the main picture's size in pixels is equal to or smaller than the display area's size in pixels;

reducing the main picture's size in pixels and displaying the reduced main picture on the display area if the main picture's size in pixels is not equal to or smaller than the display areas's size in pixels and a thumbnail is not contained in the picture data file;

reducing the main picture's size in pixels and displaying the reduced main picture on the display area if the main picture's size in pixels is not equal to or smaller than the display area's size in pixels, the thumbnail is contained in the picture data file and the ratio of the thumbnail's size in pixels to the display area's size in pixels is equal to or less than the predetermined value;

displaying the thumbnail on the display area if the main picture's size in pixels is not equal to or smaller than the display area's size in pixels, the thumbnail is contained in the picture data file, the thumbnail's size in pixels is equal to or smaller than the display area's size in pixels, and the ratio of the thumbnail's size in pixels to the display area's size in pixels is not equal to or less than said predetermined value; and reducing the thumbnail's size in pixels and displaying the reduced thumbnail on the display area if the main picture's size in pixels is not equal to or smaller than the display area's size pixels, the thumbnail is contained in the picture data file, and the thumbnail's size in pixels is not equal to or smaller than the display areas size in pixels.

4. The picture displaying method as set forth in claim 3, wherein:

the main picture's size in pixels is determined to be not equal to or smaller than the display area's size in pixels if the main picture's height in pixels is greater than the display area's height in pixels or the main picture's width in pixels is greater than the display area's width in pixels, the main picture's size in pixels is determined to be smaller than the display area's size in pixels if the main picture's height in pixels is less than the display area's height in pixels and the main picture's width in pixels is less than the display area's width in pixels, the thumbnail's size in pixels is determined to be not equal to or smaller than the display area's size in pixels if the thumbnail's height in pixels is greater than the display area's height in pixels or the thumbnail's width in pixels is greater than the display area's width in pixels, and the thumbnail's size in pixels is determined to be smaller than the display area's size in pixels if the thumbnail's height in pixels is less than the display area's height in pixels and the thumbnail's width in pixels is less than the display area's width in pixels.

5. An information device for displaying, on a display area, a picture contained in a picture data file, said information device comprising:

a first controller part that determines whether the size in pixels of a main picture contained in the picture data file is equal to or smaller than the display area's size in pixels;

a second controller part that determines whether a thumbnail is contained in the picture data file;

a third controller part responsive to a thumbnail being contained in the picture data file, that determines whether the thumbnail's size in pixels is equal to or smaller than the display area's size in pixels;

a fourth controller part that applies the main picture to the display area for display thereon if the main picture's size in pixels is equal to or smaller than the display area's size in pixels;

a fifth controller part that reduces the main picture's size in pixels and applies the reduced main picture to the display area for display thereon if the main picture's size in pixels is not equal to or smaller than the display area's size in pixels and a thumbnail is not contained in the picture data file;

a sixth controller part that applies the thumbnail to the display area for display thereon if the main picture's size in pixels is not equal to or smaller than the display area's size in pixels, the thumbnail is contained in the picture data file, and the thumbnail's size in pixels is equal to or smaller than the display area's size pixels; and a seventh controller part that reduces the thumbnail's size in pixels and applies the reduced thumbnail to the display area for display thereon if the main picture's size in pixels is not equal to or smaller than the display area's size in pixels, the thumbnail is contained in the picture data file, and the thumbnail's size in pixels is not equal to or smaller than the display area's size in pixels.

6. The information device as set forth in claim 5, wherein:

said first controller part determines that the main picture's size in pixels is not equal to or smaller than the display area's size in pixels if the main picture's height in pixels is greater than the display area's height in pixels or the main picture's width in pixels is greater than the display area's width in pixels, said first controller part determines that the main picture's size in pixels is smaller than the display area's size in pixels if the main picture's height in pixels is less than the display area's height in pixels and the main picture's width in pixels is less than the display area's width in pixels, said third controller part determines that the thumbnail's size in pixels is not equal to or smaller than the display area's size in pixels if the thumbnail's height in pixels is not equal to or smaller than the display area's height in pixels or the thumbnail's width in pixels is not equal to or smaller than the display area's width in pixels, and said third controller part determines that the thumbnail's size in pixels is smaller than the display area's size in pixels if the thumbnail's height in pixels is less than the display area's height in pixels and the thumbnail's width in pixels is less than the display area's width in pixels.

7. An information device for displaying, on a display area, a picture contained in a picture data file, said information device comprising:

a first controller part that determines whether the size in pixels of a main picture contained in the picture data file is equal to or smaller than the display area's size in pixels;

a second controller part that determines whether a thumbnail is contained in the picture data file;

a third controller part responsive to a thumbnail being contained in the picture data file, that determines whether the thumbnail's size in pixels is equal to or smaller than the display area's size in pixels;

a fourth controller part responsive to a thumbnail being contained in the picture data file, that determines whether a ratio of the thumbnail's size in pixels to the display area's size in pixels is equal to or less than a predetermined value;

a fifth controller part that applies the main picture to the display area for display thereon if the main picture's size in pixels is equal to or smaller than the display area's size in pixels;

a sixth controller part that reduces the main picture's size in pixels and applies the reduced main picture to the display area for display thereon if the main picture's size in pixels is not equal to or smaller than the display area's size in pixels and a thumbnail is not contained in the picture data file;

a seventh controller part that reduces the main picture's size in pixels and applies the reduced main picture to the display area for display thereon if the main picture's size in pixels is not equal to or smaller than the display area's size in pixels, the thumbnail is contained in the picture data file and the ratio of the thumbnail's size in pixels to the display area's size in pixels is equal to or less than the predetermined value;

an eighth controller part that applies the thumbnail to the display area for display thereon if the main picture's size in pixels is not equal to or smaller than the display area's size in pixels, the thumbnail is contained in the picture data file, the thumbnail's size in pixels is equal to or smaller than the display area's size in pixels, and the ratio of the thumbnail's size in pixels to the display area's size in pixels is greater than the predetermined value; and a ninth controller part that reduces the thumbnail's size in pixels and applies the reduced thumbnail to the display area for display thereon if the main picture's size in pixels is larger than the display area's size in pixels, the thumbnail is contained in the picture data file, and the thumbnail's size in pixels is larger than the area's size in pixels.

8. The information device as set forth in claim 7, wherein:

said first controller part determines that the main picture's size in pixel is not equal to or smaller than the display area's size in pixels if the main picture's height in pixels is greater than the display area's height in pixels or the main picture's width in pixels is greater than the display area's width in pixels, said first controller part determines that the main picture's size in pixels is smaller than the display area's size in pixels if the main picture's height in pixels is less than the display area's height in pixels and the main picture's width in pixels is less than the display area's width in pixels, said third controller part determines that the thumbnail's size in pixels is not equal to or smaller than the display area's size in pixels if the thumbnail's height in pixels is greater than the display area's height in pixels or the thumbnail's width in pixels is greater than the display area's width in pixels, and said third controller part determines that the thumbnail's size in pixels is smaller than the display area's size in pixels if the thumbnail's height in pixels is less than the display area's height in pixels and the thumbnail's width in pixels is less than the display area's width in pixels.

9. A computer program product embodied on a computer-readable medium and comprising codes that, when executed, cause a computer to perform a picture displaying method for displaying, on a display area, a picture contained in a picture data file, said method comprising:

determining whether the size in pixels of a main picture contained in the picture data file is equal to or smaller than the display area's size in pixels;

determining whether a thumbnail is contained in the picture data file;

if a thumbnail is contained in the picture file, determining whether the thumbnail's size in pixels is equal to or smaller than the display area's size in pixels;

displaying the main picture on the display area if the main picture's size in pixels is equal to or smaller than the display area's size in pixels;

reducing the main picture's size in pixels and displaying the reduced main picture on the display area if the main picture's size in pixels is not equal to or smaller than the display area's size in pixels and a thumbnail is not contained in the picture data file;

displaying the thumbnail on the display area if the main picture's size in pixels is not equal to or smaller than the display area's size in pixels, the thumbnail is contained in the picture data file, and the thumbnail's size in pixels is equal to or smaller than the display area's size in pixels; and reducing the thumbnail's size in pixels and displaying the reduced thumbnail on the display area if the main picture's size in pixels is not equal to or smaller than the display area's size in pixels, the thumbnail is contained in the picture data file, and the thumbnail's size in pixels is not equal to or smaller than the display area's size in pixels.

10. The computer program product as set forth in claim 9, wherein:

the main picture's size in pixels is determined to be not equal to or smaller than the display area's size in pixels if the main picture's height in pixels is greater than the display area's height in pixels or the main picture's width in pixels is greater than the display area's width in pixels, the main picture's size in pixels is determined to be smaller than the display area's size in pixels if the main picture's height in pixels is less than the display area's height in pixels and the main picture's width in pixels is less than the display area's width in pixels, the thumbnail's size in pixels is determined to be not equal to or smaller than the display area's size in pixels if the thumbnail's height in pixels is greater than the display area's height in pixels or the thumbnail's width in pixels is greater than the display area's width in pixels, and the thumbnail's size in pixels is determined to be smaller than the display area's size in pixels if the thumbnail's height in pixels is less than the display area's height in pixels and the thumbnail's width in pixels is less than the display area's width in pixels.

11. A computer program product embodied on a computer-readable medium and comprising codes that, when executed, cause a computer to perform a picture displaying method for displaying, on a display area, a picture contained in a picture data file, said method comprising:

determining whether the size in pixels of a main picture contained in the picture data file is equal to or smaller than the display area's size in pixels;

determining whether a thumbnail is contained in said picture data file;

if a thumbnail is contained in the picture data file, determining whether a ratio of the thumbnail's size in pixels to the display area's size in pixels is equal to or less than a predetermined value;

if a thumbnail is contained in the picture data file, determining whether the thumbnail's size in pixels is equal to or smaller than the display area's size in pixels;

displaying the main picture on the display area if the main picture's size in pixels is equal to or smaller than the display area's size in pixels;

reducing the main picture's size in pixels and displaying the reduced main picture on the display area if the main picture's size in pixels is not equal to or smaller than the display area's size in pixels and a thumbnail is not contained in the picture data file; reducing the main picture's size in pixels and displaying the reduced main picture on the display area if the main picture's size in pixels is not equal to or smaller than the display area's size in pixels, the thumbnail is contained in the picture data file and the ratio of the thumbnail's size in pixels to the display area's size in pixels is equal to or less than the predetermined value;

displaying the thumbnail on the display area if the main picture's size in pixels is not equal to or smaller than the display area's size in pixels, the thumbnail is contained in the picture data file, the thumbnail's size in pixels is equal to or smaller than the display area's size in pixels, and the ratio of the thumbnail's size in pixels to the display area's size in pixels is not equal to or less than said predetermined value; and reducing the thumbnail's size in pixels and displaying the reduced thumbnail on the display area if the main picture's size in pixels is not equal to or smaller than the display area's size in pixels, the thumbnail is contained in the picture data file, and the thumbnail's size in pixels is not equal to or smaller than the display area's size in pixels.

12. The computer program product as set forth in claim 11, wherein:

the main picture's size in pixels is determined to be not equal to or smaller than the display area's size in pixels if the main picture's height in pixels is greater than the display area's height in pixels or the main picture's width in pixels is greater than the display area's width in pixels, the main picture's size in pixels is determined to be smaller than the display area's size in pixels if the main picture's height in pixels is less than the display area's height in pixels and the main picture's width in pixels is less than the display area's width in pixels, the thumbnail's size in pixels is determined to be not equal to or smaller than the display area's size in pixels if the thumbnail's height in pixels is greater than the display area's height in pixels or the thumbnail's width in pixels is greater than the display area's width in pixels, and the thumbnail's size in pixels is determined to be smaller than the display area's size in pixels if the thumbnail's height in pixels is less than the display area's height in pixels and the thumbnail's width in pixels is less than the display area's width in pixels.

13. A picture displaying method for displaying, on a display area, a picture contained in a picture data file or a thumbnail contained in the picture data file, said method comprising:

determining whether the size of a main picture contained in the picture data file is equal to or smaller than the display area's size;

determining whether the size of a thumbnail contained in the data file is equal to or smaller than the display area's size;

displaying the main picture on the display area if the main picture's size is equal to or smaller than the display area's size;

displaying the thumbnail on the display area if the main picture's size is not equal to or smaller than the display area's size and the thumbnail's size is equal to or smaller than the display area's size; and reducing the thumbnail's size and displaying the reduced thumbnail on the display area if the main picture's size is not equal to or smaller than the display area's size and the thumbnail's size is not equal to or smaller than the display area's size.

14. A picture displaying method for displaying, on a display area, a picture contained in a picture data file or a thumbnail contained in the picture data file, said method comprising:

determining whether the size of a main picture contained in the picture data file is equal to or smaller than the display area's size;

determining whether the size of a thumbnail contained in the picture data file is equal to or smaller than the display area's size;

determining whether a ratio of the thumbnail's size to the display area's size is equal to or less than a predetermined value;

displaying the main picture on the display area if the main picture's size is equal to or smaller than the display area's size;

reducing the main picture's size and displaying the reduced main picture on the display area if the main picture's size is not equal to or smaller than the display area's size and the ratio of the thumbnail's size to the display area's size is equal to or less than the predetermined value;

displaying the thumbnail on said display area if the main picture's size is not equal to or smaller than the display area's size, the thumbnail's size is equal to or smaller than the display area's size, and the ratio of the thumbnail's size to the display area's size is not equal to or less than said predetermined value; and reducing the thumbnail's size and displaying the reduced thumbnail if the main picture's size is not equal to or smaller than the display area's size and the thumbnail's size is not equal to or smaller than the area's size.

15. An information device for displaying, on a display area, a picture contained in a picture data file or a thumbnail contained in the picture data file, said information device comprising:

a first controller part that determines whether the size of a main picture contained in the picture data file is equal to or smaller than the display area's size;

a second controller part that determines whether the size of a thumbnail contained in the picture data file is equal to or smaller than the display area's size;

a third controller part that applies the main picture to the display area for display thereon if the main picture's size is equal to or smaller than the display area's size;

a fourth controller part that applies the thumbnail to the display area for display thereon if the main picture's size is not equal to or smaller than the display area's size and the thumbnail's size is equal to or smaller than the display area's size; and a fifth controller part that reduces the thumbnail's size and applying the reduced thumbnail to the display area for display thereon if the main picture's size is not equal to or smaller than the display area's size and the thumbnail's size is not equal to or smaller than the display area's size.

16. An information device for displaying, on a display area, a picture contained in a picture data file or a thumbnail displayed in the picture data file, said information device comprising:

a first controller part that determines whether the size of a main picture contained in the picture data file is equal to or smaller than the display area's size;

a second controller part that determines whether the size of a thumbnail contained in the picture data file is equal to or smaller than the display area's size;

a third controller part that determines whether a ratio of the thumbnail's size to the display area's size is equal to or less than a predetermined value;

a fourth controller part that applies the main picture to the display area for display thereon if the main picture's size is equal to or smaller than the display area's size;

a fifth controller part that reduces the main picture's size and applying the reduced main picture to the display area for display thereon if the main picture's size is not equal to or smaller than the display area's size and the ratio of the thumbnail's size to the display area's size is equal to or less than the predetermined value;

a sixth controller part that applies the thumbnail to the display area for display thereon if the main picture's size is not equal to or smaller than the display area's size, the thumbnail's size is equal to or smaller than the display area's size, and the ratio of the thumbnail's size to the display area's size is greater than the predetermined value; and a seventh controller part that reduces the thumbnail's size and applying the reduced thumbnail to the display area for display thereon if the main picture's size is larger than the display area's size and the thumbnail's size is larger than the display area's size.

17. A computer program product embodied on a computer-readable medium and comprising codes that, when executed, cause a computer to perform a picture displaying method for displaying, on a display area, a picture contained in a picture data file or a thumbnail contained in the picture data file, said method comprising:

determining whether the size of a main picture contained in the picture data file is equal to or smaller than the display area's size in pixel;

determining whether the size of a thumbnail contained in the picture data file is equal to or smaller than the display area's size;

displaying the main picture on the display area if the main picture's size is equal to or smaller than the display area's size;

displaying the thumbnail on the display area if the main picture's size is not equal to or smaller than the display area's size and the thumbnail's size is equal to or smaller than the display area's size; and reducing the thumbnail's size and displaying the reduced thumbnail on the display area if the main picture's size is not equal to or smaller than the display area's size and the thumbnail's size is not equal to or smaller than the display area's size.

18. A computer program product embodied on a computer-readable medium and comprising codes that, when executed, cause a computer to perform a picture displaying method for displaying, on a display area, a picture contained in a picture data file or a thumbnail contained in the picture data file, said method comprising:

determining whether the size of a main picture contained in the picture data file is equal to or smaller than the display area's size;

determining whether the size of a thumbnail contained in the picture data file is equal to or smaller than the display area's size;

determining whether a ratio of the thumbnail's size to the display area's size is equal to or less than a predetermined value;

displaying the main picture on the display area if the main picture's size is equal to or smaller than the display area's size;

reducing the main picture's size and displaying the reduced main picture on the display area if the main picture's size is not equal to or smaller than the display area's size and the ratio of the thumbnail's size to the display area's size is equal to or less than the predetermined value;

displaying the thumbnail on the display area if the main picture's size is not equal to or smaller than the display area's size, the thumbnail's size is equal to or smaller than the display area's size, and the ratio of the thumbnail's size to the display area's size is not equal to or less than said predetermined value; and reducing the thumbnail's size and displaying the reduced thumbnail on the display area if the main picture's size is not equal to or smaller than the display area's size and the thumbnail's size is not equal to or smaller than the display area's size.

19. A picture displaying method for displaying, on a display area, a picture contained in a picture data file, said method comprising:

displaying a main picture on the display area if the main picture's size is equal to or smaller than the display area's size;

reducing the main picture's size and displaying the reduced main picture on the display area if the main picture's size is not equal to or smaller than the display area's size and a thumbnail of the main picture is not available;

displaying the thumbnail on the display area if the main picture's size is not equal to or smaller than the display area's size, the thumbnail is available, and the thumbnail's size is equal to or smaller than the display area's size; and reducing the thumbnail's size and displaying the reduced thumbnail on the display area if the main picture's size is not equal to or smaller than the display area's size, the thumbnail is available, and the thumbnail's size is not equal to or smaller than the display area's size.

20. A picture displaying method for displaying, on a display area, a picture contained in a picture data file, said method comprising:

displaying a main picture on the display area if the main picture's size is equal to or smaller than the display area's size;

reducing the main picture's size and displaying the reduced main picture on the display area if the main picture's size is not equal to or smaller than the display area's size and a thumbnail is not available;

reducing the main picture's size and displaying the reduced main picture on the display area if the main picture's size is not equal to or smaller than the display area's size, the thumbnail is available and the ratio of the thumbnail's size to the display area's size is equal to or less than a predetermined value;

displaying the thumbnail on the display area if the main picture's size is not equal to or smaller than the display area's size, the thumbnail is available, the thumbnail's size is equal to or smaller than the display area's size, and the ratio of the thumbnail's size to the display area's size is not equal to or less than said predetermined value; and reducing the thumbnail's size and displaying the reduced thumbnail on the display area if the main picture's size is not equal to or smaller than the display area's size, the thumbnail is available, and the thumbnail's size is not equal to or smaller than the display area's size.

21. An information device for displaying, on a display area, a picture contained in a picture data file, said information device comprising:

a first controller part that applies a main picture to the display area for display thereon if the main picture's size is equal to or smaller than the display area's size;

a second controller part that reduces the main picture's size and applies the reduced main picture to the display area for display thereon if the main picture's size is not equal to or smaller than the display area's size and a thumbnail is not available;

a third controller part that applies the thumbnail to the display area for display thereon if the main picture's size is not equal to or smaller than the display area's size, the thumbnail is available, and the thumbnail's size is equal to or smaller than the display area's size; and a fourth controller part that reduces the thumbnail's size and applies the reduced thumbnail to the display area for display thereon if the main picture's size is not equal to or smaller than the display area's size, the thumbnail is available, and the thumbnail's size is not equal to or smaller than the display area's size.

22. An information device for displaying, on a display area, a picture contained in a picture data file, said information device comprising:

a first controller part that applies a main picture to the display area for display thereon if the main picture's size is equal to or smaller than the display area's size;

a second controller part that reduces the main picture's size and applies the reduced main picture to the display area for display thereon if the main picture's size is not equal to or smaller than the display area's size and a thumbnail is not available;

a third controller part that reduces the main picture's size and applies the reduced main picture to the display area for display thereon if the main picture's size is not equal to or smaller than the display area's size, the thumbnail is available and the ratio of the thumbnail's size to the display area's size is equal to or less than the predetermined value;

an fourth controller part that applies the thumbnail to the display area for display thereon if the main picture's size is not equal to or smaller than the display area's size, the thumbnail is available, the thumbnail's size is equal to or smaller than the display area's size, and the ratio of the thumbnail's size to the display area's size is greater than the predetermined value; and a fifth controller part that reduces the thumbnail's size and applying the reduced thumbnail to the display area for display thereon if the main picture's size is larger than the display area's size, the thumbnail is available, and the thumbnail's size is larger than the area's size.

23. A computer program product embodied on a computer-readable medium and comprising codes that, when executed, cause a computer to perform a picture displaying method for displaying, on a display area, a picture contained in a picture data file, said method comprising:

displaying a main picture on the display area if the main picture's size is equal to or smaller than the display area's size;

reducing the main picture's size and displaying the reduced main picture on the display area if the main picture's size is not equal to or smaller than the display area's size and a thumbnail is not available;

displaying the thumbnail on the display area if the main picture's size is not equal to or smaller than the display area's size, the thumbnail is available, and the thumbnail's size is equal to or smaller than the display area's size; and reducing the thumbnail's size and displaying the reduced thumbnail on the display area if the main picture's size is not equal to or smaller than the display area's size, the thumbnail is available, and the thumbnail's size is not equal to or smaller than the display area's size.

24. A computer program product embodied on a computer-readable medium and comprising codes that, when executed, cause a computer to perform a picture displaying method for displaying, on a display area, a picture contained in a picture data file, said method comprising: determining whether the size of a main picture available is equal to or smaller than the display area's size;

displaying a main picture on the display area if the main picture's size is equal to or smaller than the display area's size;

reducing the main picture's size and displaying the reduced main picture on the display area if the main picture's size is not equal to or smaller than the display area's size and a thumbnail is not available;

reducing the main picture's size and displaying the reduced main picture on the display area if the main picture's size is not equal to or smaller than the display area's size, the thumbnail is available and the ratio of the thumbnail's size to the display area's size is equal to or less than the predetermined value;

displaying the thumbnail on the display area if the main picture's size is not equal to or smaller than the display area's size, the thumbnail is available, the thumbnail's size is equal to or smaller than the display area's size, and the ratio of the thumbnail's size to the display area's size is not equal to or less than said predetermined value; and reducing the thumbnail's size and displaying the reduced thumbnail on the display area if the main picture's size is not equal to or smaller than the display area's size, the thumbnail is available, and the thumbnail's size is not equal to or smaller than the display area's size.

* * * * *